United States Patent [19]

Masubuchi

[11] Patent Number: 4,730,140

[45] Date of Patent: Mar. 8, 1988

[54] METHOD OF DRIVING DIODE TYPE DISPLAY UNIT

[75] Inventor: Sadao Masubuchi, Tokorozawa, Japan

[73] Assignee: Citizen Watch Co., Ltd., Tokyo, Japan

[21] Appl. No.: 941,521

[22] Filed: Dec. 11, 1986

Related U.S. Application Data

[63] Continuation of Ser. No. 676,950, Nov. 30, 1984, abandoned.

[30] Foreign Application Priority Data

Dec. 2, 1983 [JP] Japan ..... 58-228240

[51] Int. Cl.[4] ..... G09G 3/10; G09G 3/00

[52] U.S. Cl. ..... 315/169.3; 315/169.1; 315/169.2; 313/500; 350/339 R; 350/333; 340/805; 340/784

[58] Field of Search ..... 315/169.1, 169.2, 169.3; 313/500; 326/1; 350/339 R, 332, 333; 340/805, 784

[56] References Cited

U.S. PATENT DOCUMENTS

| | | | |
|---|---|---|---|
| 2,774,813 | 12/1956 | Livingston | 315/169.3 |
| 2,818,531 | 12/1957 | Peck, Jr. | 315/169.3 |
| 3,654,476 | 4/1972 | Hakki | 313/500 |
| 3,665,246 | 5/1972 | Kurahashi et al. | 315/169.3 |
| 3,909,804 | 9/1975 | Kaji et al. | 315/169.3 |
| 4,127,792 | 11/1978 | Nakata | 313/500 |
| 4,319,237 | 3/1982 | Matsuo et al. | 340/784 |
| 4,413,883 | 11/1983 | Baraff et al. | 350/333 |
| 4,523,811 | 6/1985 | Ota | 350/333 |
| 4,534,623 | 8/1985 | Araki | 350/333 |
| 4,547,092 | 10/1985 | Ngo | 350/339 R |

*Primary Examiner*—David K. Moore
*Assistant Examiner*—Michael Razavi
*Attorney, Agent, or Firm*—Sherman and Shalloway

[57] ABSTRACT

A method of driving a diode type display unit in which a charge regulating period is added to driving signal waveform in order to regulate amount of charge in a display picture element capacitor in the display unit wherein a two-terminal element having nonlinear current-voltage characteristics is provided two-dimensionally on a substrate, an electrooptical element capable of controlling the optical quality by means of applied voltage is disposed in response to the two-terminal element, charge is injected into the electrooptical element by utilizing the current-voltage nonlinearity in the two-terminal element for writing period, and the charge injected is held by utilizing the current-voltage nonlinearity in the two-terminalelement for holding period thereby effectig display.

2 Claims, 6 Drawing Figures

FIG. 2
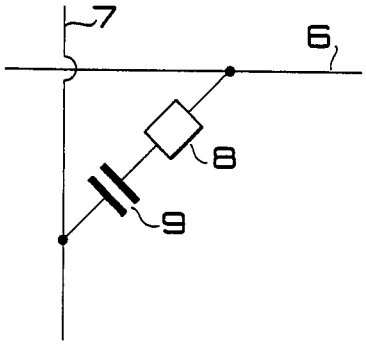
FIG. 4
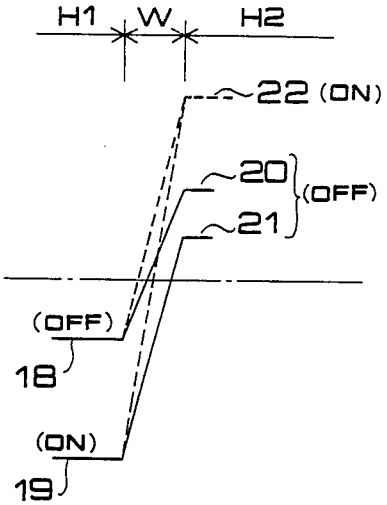
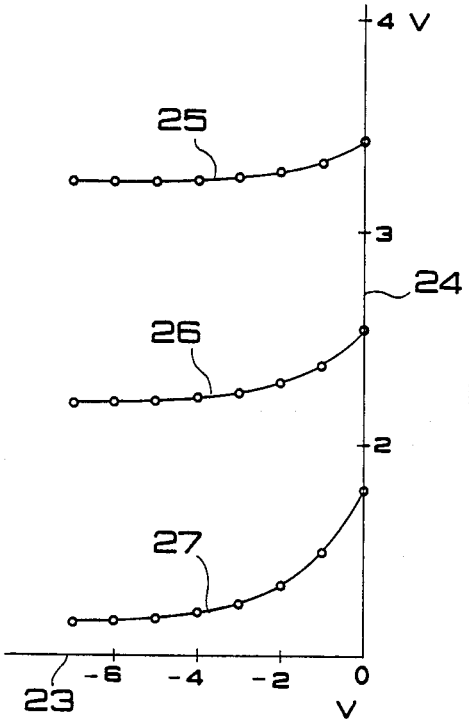
FIG. 5

METHOD OF DRIVING DIODE TYPE DISPLAY UNIT

This application is a continuation, of application Ser. No. 676,950 filed 11/30/84 now abandoned.

BACKGROUND OF THE INVENTION

1. Field of the Invention

This invention relates to a method of driving a diode type display unit wherein display is carried out by means of a combination of a two-terminal element and an electrooptical element.

2. Description of the Prior Art

The term "two-terminal element" used herein means elements, of which the voltage-current characteristics exhibit nonlinearity such as PN junction diode, metal-insulating layer-metal diode (hereinafter referred to simply as "MiM diode") and the like. On the other hand, the term "electrooptical element" means elements, of which the optical quality is controlled by means of impressed voltage such as liquid crystal element, electrochromic element, PLZT element, electroluminescent element, plasma luminescent element, fluorescence luminescent element and the like.

For the sake of simplicity, a MiM diode and a liquid crystal element are utilized as the two-terminal element and the electrooptical element, respectively, in the following description.

FIG. 1 shows a construction of a diode type display unit wherein reference numeral 1 designates an input signal line, i.e., input line of display information, reference numeral 5 designates a display panel part, and this display panel part is one obtained by disposing a unit picture element shown in two dimensional manner in FIG. 2. A scanning electrode line driving circuitry part 3 applies a prescribed voltage to scanning electrode lines of the display panel part. A signal electrode line driving circuitry part 4 applies a prescribed voltage to a signal electrode display panel part 5. A controlling part 2 supplies control signals to the scanning electrode line driving circuitry part 3 and the signal electrode line driving circuitry part 4, respectively, in order to display input information.

In the unit picture element shown in FIG. 2, reference numeral 6 designates a scanning electrode line, 7 a signal electrode line, 8 a MiM diode being a two-terminal element, and 9 a display picture element capacitor composed of a liquid crystal layer being an electrooptical element and a display electrode, respectively.

FIG. 3 illustrates a conventional driving signal waveform wherein scanning electrode signal waveform is represented by solid line whilst signal electrode signal waveform is represented by dotted line. This driving signal waveform consists of two types of periods, i.e., writing periods designated by W and holding periods designated by H in FIG. 3. A pulsing signal 10 or 12 is applied to the scanning electrode line during the writing period W whilst a holding signal 11 or 13 is applied during the holding period H.

On one hand, ON signal 14 or 16 is applied to the signal electrode line in the case when a picture element is in ON display (voltage of display picture element capacitor is high) whilst OFF signal 15 or 17 is applied when the picture element is in OFF display (voltage of the display picture element capacitor is low). Problem of halftone can be solved by setting the voltage signal between OFF and ON signals. During the writing period W, charge is injected into the display picture element capacitor in accordance with display information, and charge of the display picture element capacitor is held by utilizing current-voltage nonlinearity of MiM diode during the holding period H. Since the voltage corresponding to the charge which has been held is continuously applied to the liquid crystal layer, high quality display is possible in comparison with voltage equalization driving method which exhibits remarkable deterioration in display quality due to increase of number of scanning electrodes.

The problem of such conventional driving method composed of the writing and holding periods as mentioned above resides in that the charge of the display picture element capacitor immediately after the writing period depends upon the charge which has been written in the preceding writing period to the aforesaid writing period. In this connection, the problem will be more specifically described by referring to FIG. 4 wherein reference character W designates a writing period, and $H_1$, $H_2$ holding periods before and after the writing period, respectively. In FIG. 4, voltage across both ends of the display picture element capacitor 9 is plotted as ordinate and time as abscissa wherein reference numerals 18 and 19 designate voltages across both the ends of the display picture element capacitor 9 in case of OFF display and ON display during the holding period $H_1$, respectively, numeral 22 designates a voltage during the holding period $H_2$ when the charge corresponding to ON display was written during the writing period W, and numerals 20, 21 designate voltages when OFF displays were written, respectively. When ON display was written, the voltage after writing becomes the situation 22 in either case that display is ON 18 or OFF 19 during the holding period $H_1$. As a result, the ON display voltage 22 is obtained, which does not depend on the display situation prior to the writing period. On the other hand, when OFF display was written during the writing period W, the situation 18 becomes the voltage 20 in case of OFF display during the holding period $H_1$ whilst the situation 19 becomes the voltage 21 in case of ON display during the holding period $H_2$. In other words, the voltages in case of OFF display during the holding period $H_2$ depend upon the display situation before writing period as represented by reference numerals 20 and 21. Such dependence results in decrease in display quality such as display reliability, contrast ratio, and the like.

SUMMARY OF THE INVENTION

It is an object of the present invention to provide a method of driving a diode type display unit, which has high display quality and can eliminate the above-mentioned disadvantage by contriving a method for driving conventional display units.

More specifically, the present invention relates to a method for driving a diode type display unit characterized by adding a charge regulating period to driving signal waveform in order to regulate amount of charge in a display picture element capacitor in said diode type display unit wherein a two-terminal element having nonlinear current-voltage characteristics is provided two-dimensionally on a substrate, an electrooptical element capable of controlling the optical quality by means of applied voltage is disposed in response to said two-terminal element, charge is injected into said electrooptical element by utilizing the current-voltage nonlinearity in said two-terminal element for the writing period, and the charge injected is held by utilizing the current-voltage nonlinearity in said two-terminal element for the holding period thereby effecting display.

The above and other objects of the invention will become apparent from the following detailed description taken in conjunction with the accompanying drawings.

BRIEF DESCRIPTION OF THE DRAWINGS

FIG. 2 is a circuit diagram showing connection of a diode with display picture element capacity;

FIG. 4 is an explanatory diagram illustrating a mechanism for injecting charge;

FIG. 5 is a graphic representation indicating each relationship between an initial voltage and the voltage the after injecting charge.

DETAILED DESCRIPTION OF THE PREFERRED EMBODIMENT

Figure 1:
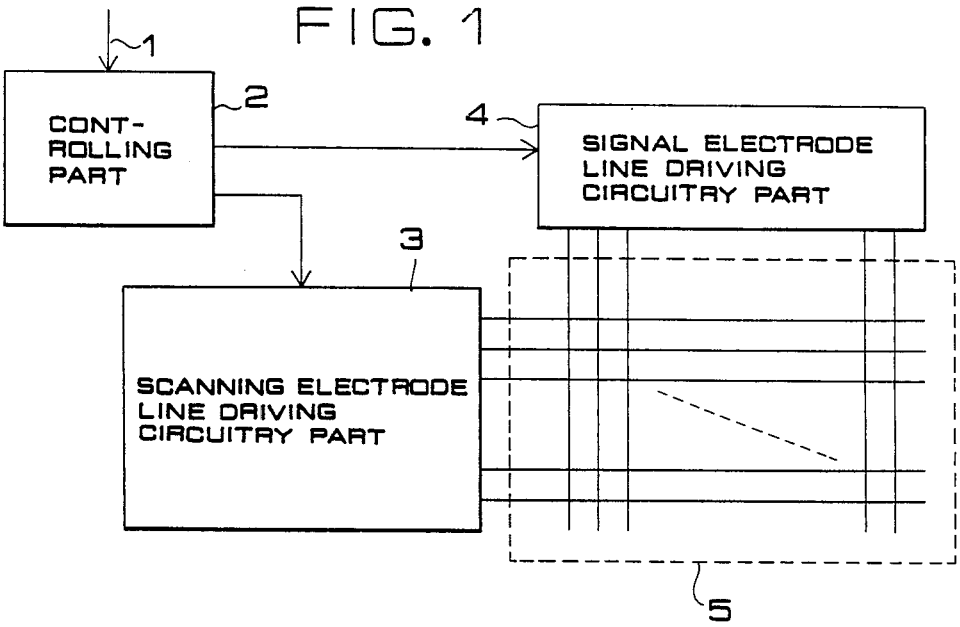
FIG. 1 is a block diagram showing a construction of a diode type display unit.
Figure 3:
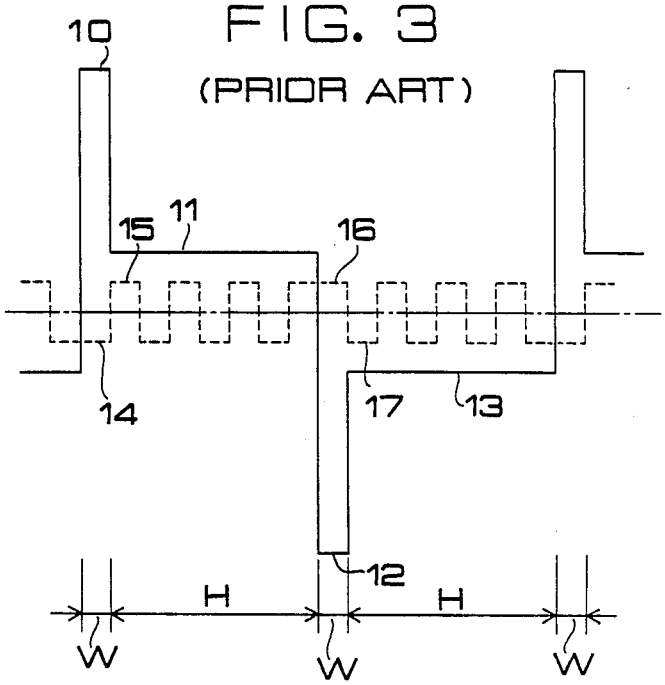
FIG. 3 (PRIOR ART)
FIG. 3 is a waveform diagram indicating a conventional driving signal waveform.

The ground for adding a charge regulating period in the method of the present invention will be described hereinbelow by referring to FIG. 5 wherein voltage of a display picture element capacitor during holding period $H_1$ is plotted as abcissa 23, and voltage of the display picture element capacitor after completing the writing period W is plotted as an ordinate 24. The picture element has dimension of 100 $\mu$m square, and thickness of liquid crystal cell is 10 $\mu$m.

Current-voltage characteristics of MiM diode may be expressed as follows:

$$i = KV \times \exp(\beta \sqrt{V}),$$

wherein $K = 1 \times 10^{-14}$ and $\beta = 4$. In this case, a capacity of the MiM diode is 0.01 pF.

In FIG. 5, reference numerals 25, 26, and 27 designate such a case where the voltage across the scanning electrode line 6 and the signal electrode line 7 during writing period is 10 volts, 9 volts, and 8 volts, respectively. It has been found in FIG. 5 that the more negative voltage of display picture element capacitor during the holding period $H_1$ causes the less voltage difference after completing the writing period.

In this connection, more specific explanation will be made in conjunction with the case that a voltage is 8 volts and represented by reference numeral 27. If voltages of display picture element capacitor are −1 volt and −3 volts during the holding period $H_1$, the voltage difference after completing writing period becomes 0.25 volt. On the other hand, if voltages are −4 volts and −6 volts during the holding period, the voltage difference decreases, the value of which reaches only 0.04 volt.

The addition of a charge regulating period to driving signal waveform in the present invention is based on the above described phenomenon, whereby disadvantages of prior art methods can be eliminated.

Figure 6:
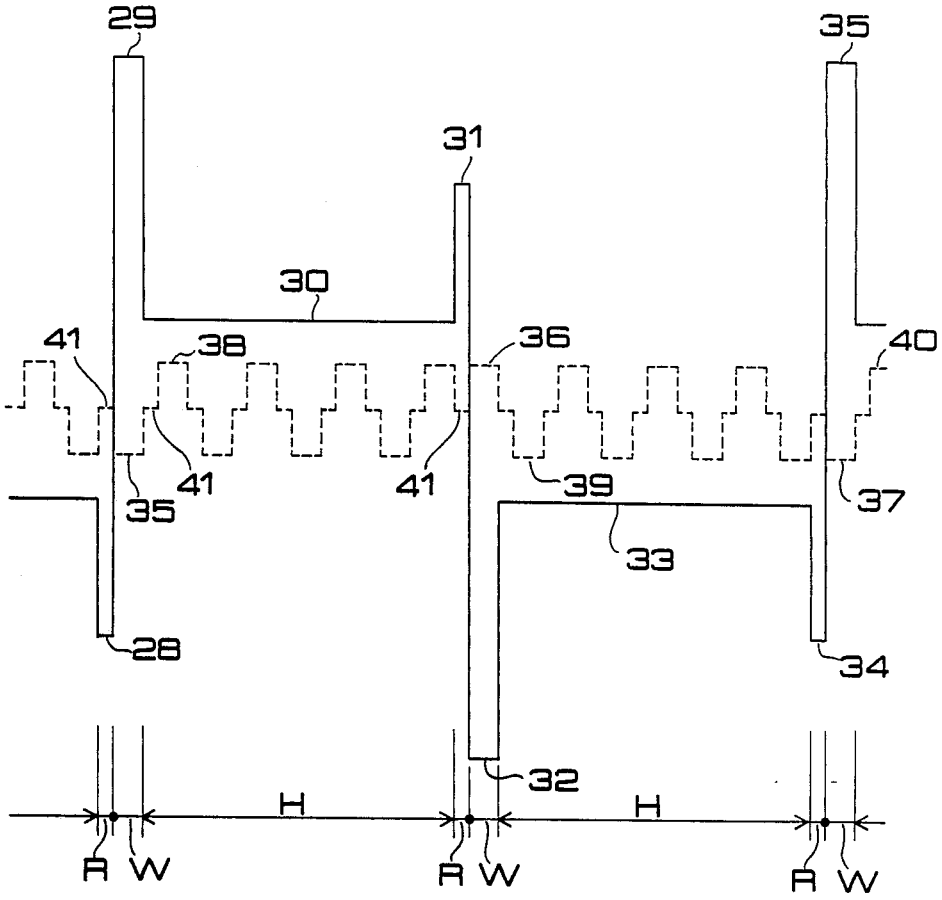
FIG. 6 is a waveform diagram indicating the driving signal waveform according to the present invention.

FIG. 6 indicates the driving signal waveform according to the present invention wherein scanning electrode signal waveform is represented by a solid line whilst signal electrode signal waveform is represented by a dotted line. The driving signal waveform consists of three periods, i.e., writing and holding periods W and H being similar to those of conventional examples as well as the charge regulating period R which is added in the present invention. Pulse signals 29, 32, and 35 are added to the scanning electrode line during writing period whilst holding siganls 30, and 33 are applied during the holding period as in conventional examples. ON signals 35, 36, and 37 are applied to the signal electrode line when the picture element is in ON display whilst OFF signals 38, 39, and 40 are applied when the picture element is in OFF display as in conventional examples. During the new charge regulating period R, charge regulation pulsing signals 28, 31, and 34 are applied to the scanning electrode line whilst a charge regulating signal 41 is applied to the signal electrode line. During the charge regulating period R, charge having the same sign with that of the charge accumulated in the display picture element capacitor is injected thereinto to increase amount of charge. For electric potential of the charge regulating signal 41, any potential may be utilized so far as such potential increases amount of charge, but ON signal is desirable in view of simplicity of a driving circuit, and efficiency of charge injection. Namely, potential 36 is used for the charge regulation pulse signals 28 and 34 whilst potential 35 is utilized for the charge regulation pulse signal 31.

As described above, the charge regulating period is provided for driving signal waveform in the present invention, whereby a diode type display unit having high reliability in display can be realized so that remarkable advantages are obtained.

While the present invention has been described with reference to preferred embodiment thereof, many modifications and alterations may be made within the spirit and scope of the invention.

What is claimed is:

1. A method for driving a liquid crystal panel using diode elements wherein a two-terminal element having bidirectional nonlinear current-voltage characteristics is provided two-dimensionally on a substrate, an electrooptical element capable of controlling the optical quality by means of applied voltage is disposed in response to said two terminal element, charge is injected into said electrooptical element by utilizing the current-voltage nonlinearity in said two-terminal element for a writing period, the sign of the charge being reversed whenever the charge is injected during the writing period, and the charge injected is held by utilizing the current-voltage nonlinearity in said two-terminal element for a holding period thereby effecting display, the improvement comprising providing a charge regulating period immediately before said writing period functioning to regulate the amount of charge in said two-terminal element, aaplying a charge regulating voltage thereto which is large enough to enable the dependence of charge amount immediately after said writing period upon the charge amount prior to said writing period to be ignored, and reversing the sign of the charge injected for regulating the amount of the charge whenever the charge to be regulated is injected into said two-terminal element.

2. A method for driving a diode type display unit as claimed in claim 1 wherein the charge regulation is carried out by injecting such charge having the same sign with that of the charge immediately before said charge regulating period.

* * * * *